US006033496A

United States Patent [19]

Hisano et al.

[11] Patent Number: 6,033,496

[45] Date of Patent: Mar. 7, 2000

[54] HIGH FATIGUE STRENGTH GEAR

[75] Inventors: Toshio Hisano; Atsushi Amataka; Mikio Kubo; Katsuhiro Kubo, all of Saitama, Japan

[73] Assignee: Honda Giken Kogyo Kabushiki Kaisha, Tokyo, Japan

[21] Appl. No.: 08/892,096

[22] Filed: Jul. 14, 1997

[30] Foreign Application Priority Data

Jul. 12, 1996 [JP] Japan ..... 8-183694

[51] Int. Cl.[7] ..... F16H 55/06; C23C 8/26

[52] U.S. Cl. ..... 148/318

[58] Field of Search ..... 428/627, 469; 148/318; 74/640; 475/901

[56] References Cited

U.S. PATENT DOCUMENTS

| | | | |
|---|---|---|---|
| 3,837,845 | 9/1974 | Church | 420/92 |
| 3,856,514 | 12/1974 | Asada et al. | 420/93 |
| 4,225,365 | 9/1980 | Rice | 148/330 |
| 4,318,739 | 3/1982 | Lehman | 420/103 |

FOREIGN PATENT DOCUMENTS

| | | |
|---|---|---|
| 2830850A1 | 2/1979 | Germany . |
| 3-122254 | 5/1991 | Japan . |
| 7-018379 | 1/1995 | Japan . |

OTHER PUBLICATIONS

Japanese Kokai Patent Application No. Hei 3 [1991]–122254, English language translation, pp. 1–15, May 1991.

Derwent Accession, London: Derwent Publications Ltd., AN 95–094179, JP 7–18379 A (Aichi Seiko KK), Abstract. (no date).

Derwent Accession, London: Derwent Publications Ltd., AN 91–197335, JP 3–122254 A (Nippon Steel Corp.), Abstract. (no date).

*Primary Examiner*—John J. Zimmerman

*Attorney, Agent, or Firm*—Birch, Stewart, Kolasch & Birch, LLP

[57] ABSTRACT

A gear having a high fatigue strength can be produced relatively inexpensively. The gear is produced by plastic working using a steel material containing C≦0.01 wt %, Si≦1 wt %, 0.05 wt %≦Mn≦0.5 wt %, P≦0.1 wt %, S≦0.03 wt %, 0.02 wt %≦sol.Al≦0.1 wt %, 0.8 wt %≦Cu≦1.7 wt %, and 0.02 wt %≦Ti≦0.1 wt %, the balance being Fe and inevitable elements. The gear is subjected to soft nitriding, serving as artificial aging, after a solution treatment. The resulting gear has a sufficiently deep, surface hardened layer. Further, the gear may be produced inexpensively since the simultaneous performance of the artificial aging and soft nitriding saves energy.

20 Claims, 4 Drawing Sheets

(1) HARDNESS
(2) DISTANCE FROM SURFACE (mm)
(3) CENTRAL PORTION
(4) COMPARATIVE EXAMPLE 2(SACM 645, QUENCHING/TEMPERING, SOFT NITRIDING)
(5) COMPARATIVE EXAMPLE 3 (SCM 415H, CARBURIZING)
(6) COMPARATIVE EXAMPLE 1 (SOFT NITRIDING STEEL, SOFT NITRIDING)
(7) INVENTIVE EXAMPLE 2 (TREATMENT TIME, T=3)
(8) INVENTIVE EXAMPLE 1 (TREATMENT TIME, T=2)

(1) HARDNESS
(2) DISTANCE FROM SURFACE (mm)
(3) CENTRAL PORTION
(4) COMPARATIVE EXAMPLE 2(SACM 645, QUENCHING/TEMPERING, SOFT NITRIDING)
(5) COMPARATIVE EXAMPLE 3 (SCM 415H, CARBURIZING)
(6) COMPARATIVE EXAMPLE 1 (SOFT NITRIDING STEEL, SOFT NITRIDING)
(7) INVENTIVE EXAMPLE 2 (TREATMENT TIME, T=3)
(8) INVENTIVE EXAMPLE 1 (TREATMENT TIME, T=2)

(1) STRESS AMPLITUDE $\sigma a$
(2) NUMBER N OF REPETITIONS OF STRESS
(3) INVENTIVE EXAMPLE 2 (TREATMENT TIME, T=3)
(4) INVENTIVE EXAMPLE 1 (TREATMENT TIME, T=2)
(5) COMPARATIVE EXAMPLE 1 (SOFT NITRIDING STEEL, SOFT NITRIDING)
(6) COMPARATIVE EXAMPLE 2 (SACM 645, QUENCHING/TEMPERING, SOFT NITRIDING)
(7) COMPARATIVE EXAMPLE 3 (SCM 415H, CARBURIZING)

HIGH FATIGUE STRENGTH GEAR

BACKGROUND OF THE INVENTION

1. Field of the Invention

The present invention relates to a high fatigue strength gear, well-suited for use on an engine crank shaft.

2. Description of Background Art

Various high fatigue strength gears are known in the art. These gears are made from a soft nitriding steel, such as a low or medium carbon steel containing Al, Cr, and the like. These types of steel are specified as, for example, JIS SACM645.

Such soft nitrating steels cannot achieve an acceptable fatigue strength necessary for a gear, simply by virtue of soft nitriding, alone. Therefore, the steel is quenched and tempered to improve its inner hardness, in other words, its internal strength.

Since the soft nitriding is applied to a semi-finished gear after being mechanically worked. The hardness is increased during the quenching and tempering. This has the adverse result of limiting the mechanical workability of the steel. As a result, the fatigue strength of the gear, particularly, the bending fatigue strength of the dedendum of the gear is impaired. That is, the gear produced in this way is inferior in bending fatigue strength to a gear subjected to carburizing.

SUMMARY AND OBJECTIONS OF THE INVENTION

An object of the present invention is to provide a gear having a high fatigue strength and a high dimensional accuracy. The gear is formed from a steel material having a specific composition. The composite steel is excellent in plastic workability and mechanical workability. The specific steel is capable of being subjected to soft nitriding which serves as artificial aging after a solution treatment.

To achieve the above objects, according to the present invention, there is provided a high fatigue strength gear formed from a steel material by plastic working, the steel material containing C≦0.01 wt %, Si≦1 wt %, 0.05 wt %≦Mn≦0.5 wt %, P≦0.1 wt %, S≦0.03 wt %, 0.02 wt %≦sol.Al≦0.1 wt %, 0.8 wt %≦Cu≦1.7 wt %, and 0.02 wt %≦Ti≦0.1 wt %, the balance being Fe and inevitable elements, wherein the gear is subjected to soft nitriding serving as artificial aging, after being subjected to solution treatment.

The steel material, having the disclosed composition, has a metal structure composed of a ferrite single phase. Consequently, the steel material exhibits a desirable level of plastic workability and mechanical workability, substantially comparable to the plastic workability and mechanical workability of a mild steel.

The steel material may have its age-hardenability increased by a saturated solution of Cu. Therefore, the mechanical strength of the gear can be improved by applying an artificial aging treatment to a semi-finished gear which has been already subjected to a solution heat treatment.

Since the disclosed steel material contains Ti, as well as, a very low amount of C, it exhibits a desirable soft nitriding characteristic under an artificial aging temperature after solution treatment. In other words, in this steel material, the artificial aging temperature substantially corresponds to the soft nitriding temperature. Accordingly, the fatigue strength of the gear can be sufficiently improved without quenching and tempering. One need only applying a soft nitriding, serving as artificial aging to the semi-finished gear. Further, since both treatments, soft nitriding and artificial aging, are simultaneously performed, it is possible to achieve a savings in production costs, through at least an energy savings.

It is desirable that the depth "d" of the hardened surface layer (which means the total nitrided layer) be 0.6 mm or more. This results in an improvement in the fatigue strength of the steel. However, the upper limit of the depth "d" is 1.0 mm, for a gear having a wall thickness of 2.2 mm or more. If the depth "d" is more than 1.0 mm, the gear may be embrittled.

Since the soft nitriding is performed at a relatively low temperature, the strain on the gear generated by heat treatment is small. Accordingly, by shaving the gear prior to soft nitriding, the gear maintains its high dimensional accuracy even after soft nitriding. Thus, according to the present invention, it is possible to eliminate the finish work for a tooth flank of the gear by polishing, which is required for a gear having been carburized.

The effect of each chemical component of the above steel material, and the reason why the content of the component is limited are as follows:

Carbon (C):

Carbon is effective to form a ferrite single phase, and hence to ensure high ductility of the steel material. In order to make the hardening, caused by soft nitriding, penetrate deeper into the surface layer, the content of C should be made as small as possible. When the carbon content is more than 0.01 wt %, the ductility of the steel material is reduced, and the hardened layer on the surface is made narrower.

Silicon (Si):

Si is an element for improving the strength of the steel material. The content of Si is adjusted in accordance with the strength required for the steel material. When the content of Si is more than 1 wt %, the ductility of the steel material is reduced, and thereby the plastic workability of the steel material becomes lower.

Manganese (Mn):

Mn is an element for improving the strength of the steel material, like Si. The content of Mn is adjusted in accordance with the strength required for the steel material. When the content of Mn is more than 0.5 wt %, the ductility of the steel material is reduced, and thereby the plastic workability becomes lower. When the content of Mn is less than 0.05 wt %, the strengthening effect is lost, and also surface defects tend to be generated on the surface of the steel material.

Phosphorus (P):

P is an element for improving the strength of the steel material, line Mn. The content of P is adjusted in accordance with the strength required for the steel material. When the content of P is more than 0.1 wt %, there is a possibility that cracks will occur during secondary working on the steel material.

Sulfur (S):

The content of S is desired to be relatively small so as to enhance the ductility of the steel material. When the content of S is more than 0.03 wt %, the ductility of the steel material is significantly reduced.

Aluminum (Al):

Al is an element having an effect of enhancing the soft nitriding characteristic of the steel material. When the content of Al is more than 0.1 wt %, the plastic workability and mechanical workability of the steel material are reduced. When it is less than 0.02 wt %, the effect of enhancing the soft nitriding characteristic of the steel is lost.

Copper (Cu):

Cu gives an age-hardenability to the steel material, as described above. When the content of Cu is more than 1.7 wt %, the surface quality of the steel material is degraded. When it is less than 0.8 wt %, the age-hardenability effect is lost.

Titanium (Ti):

Ti is an element for giving a soft nitriding characteristic to the steel material containing a very low amount of carbon. Specifically, Ti forms a fine complex nitride together with Fe and makes the surface hardened layer extend deeply. When the content of Ti is more than 0.1 wt %, the surface hardened layer becomes excessively deep, resulting in the steel material being brittle. When the content of Ti is less than 0.02 wt %, the beneficial effect of Ti is lost.

The above steel material may contain Ni in an amount of 0.15 wt % to 0.7 wt %, in addition to the above elements. Ni has an effect of enhancing the surface quality of the steel material and preventing thermal embrittlement.

When a steel material, having the above composition, is used to form a steel plate, the steel material is often hot-rolled. In association with this process, a solution treatment for the steel plate is performed wherein the steel plate is rapidly cooled from a finishing temperature to a winding temperature, at the rolling step. The solution treatment can occur at the final stage of the hot-rolling process.

If the steel is hot-forged, it may be subjected to solution treatment involving rapid cooling, after completion of the hot forging, or rapid cooling after re-heating. This process serves to adjust the crystal grain sizes.

The solution treatment temperature $T_1$, which is the finishing or ending temperature of the hot rolling process, or the hot-forging process, may be set between 780° C. to 1050° C. When the temperature is less than 780° C., it is difficult to achieve a saturated solution of Cu. When the temperature is more than 1050° C., the crystal grains are coarsened, leading to a reduction in the strength and toughness of the steel.

The artificial aging temperature $T_2$ for the steel material may be set between 550° C. to 600° C. When the temperature is more than 600° C., there occurs over-aging, which leads to a reduction in the internal hardness of the steel. This renders it impossible to sufficiently improve the fatigue strength. When the temperature is less than 550° C., it is impossible to perform the artificial aging and soft nitriding.

The treatment time "t" is preferably set between 2 to 4 hours. When the treatment time is less than 2 hours, the depth "d" of the surface hardened layer is less than 0.6 mm. When the treatment time is more than 4 hours, the depth "d" exceeds the upper limit of d=1.0 mm.

The present invention provides a gear having a high fatigue strength and a high dimensional accuracy. The gear is produced from a steel material which is excellent in plastic workability and machinability and which is capable of being subjected to soft nitriding serving as artificial aging after a solution treatment. In the steps of producing the gear, artificial aging and soft nitriding steps are simultaneously performed. As a result, it is possible to achieve a savings in production costs, through at least an energy savings. Thus, a gear with improved mechanical characteristics can be formed in an inexpensive manner.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinafter, a preferred embodiment of the present invention will be described with reference to the drawings.

Figure 1:
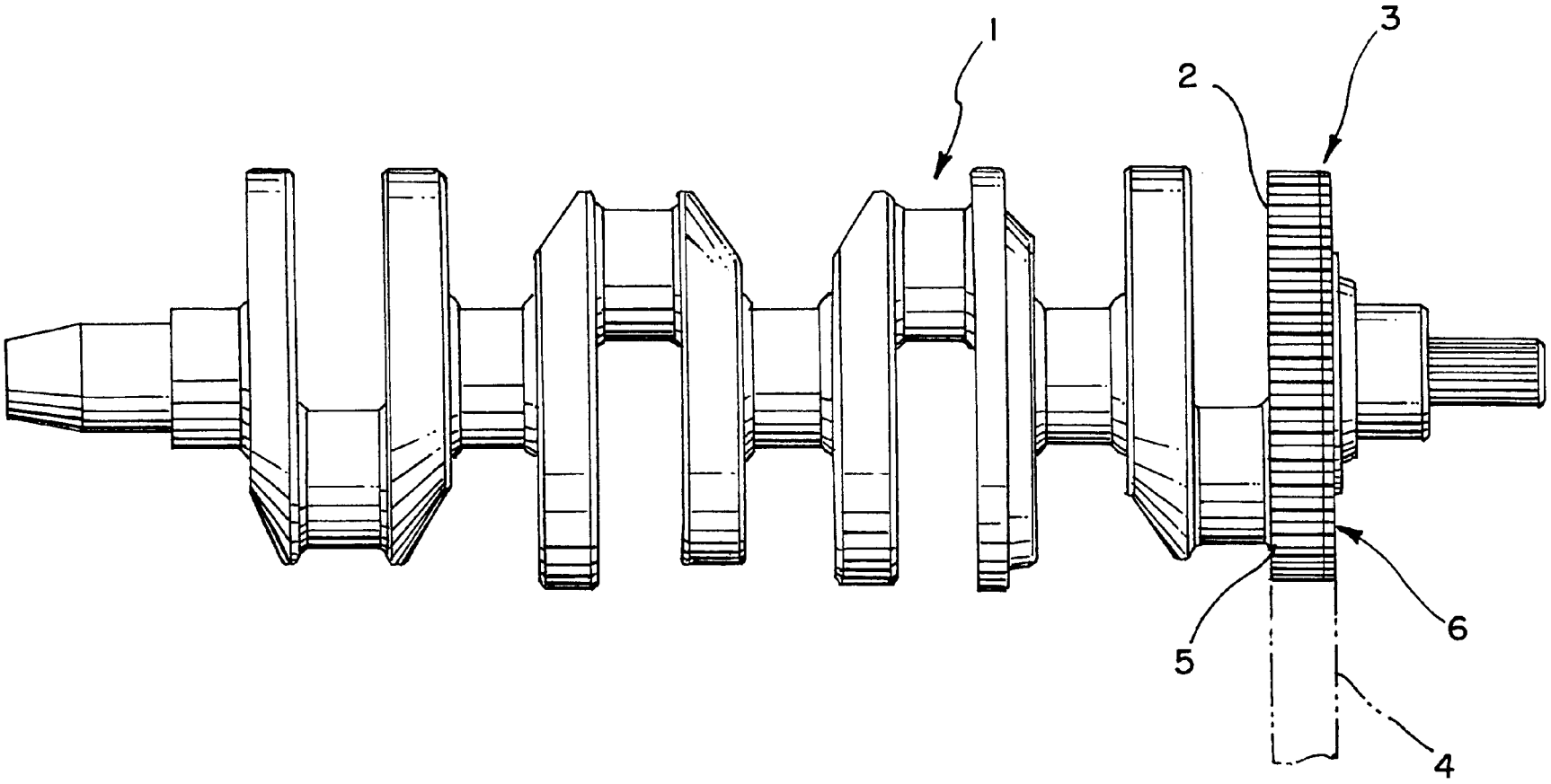
FIG. 1 is a front view of a crank shaft including a compound gear.

Referring to FIG. 1, there is shown a crank shaft 1 used for an in-line four-cylinder internal combustion engine. A rotational torque of the crank shaft 1 is transmitted to a driven gear 4 through a compound gear 3. The compound gear 3 is provided on a crank arm 2 formed at one end of the crank shaft 1 and it includes a backlash eliminating mechanism.

The compound gear 3 is composed of a main gear 5, serving as the crank arm 2, and a sub-gear 6. The sub-gear 6 is fitted around the crank shaft 1 coaxially with the main gear 5 in such a manner as to be brought in contact with the main gear 5. The sub-gear 6 is a gear produced by plastic working.

Figure 2:
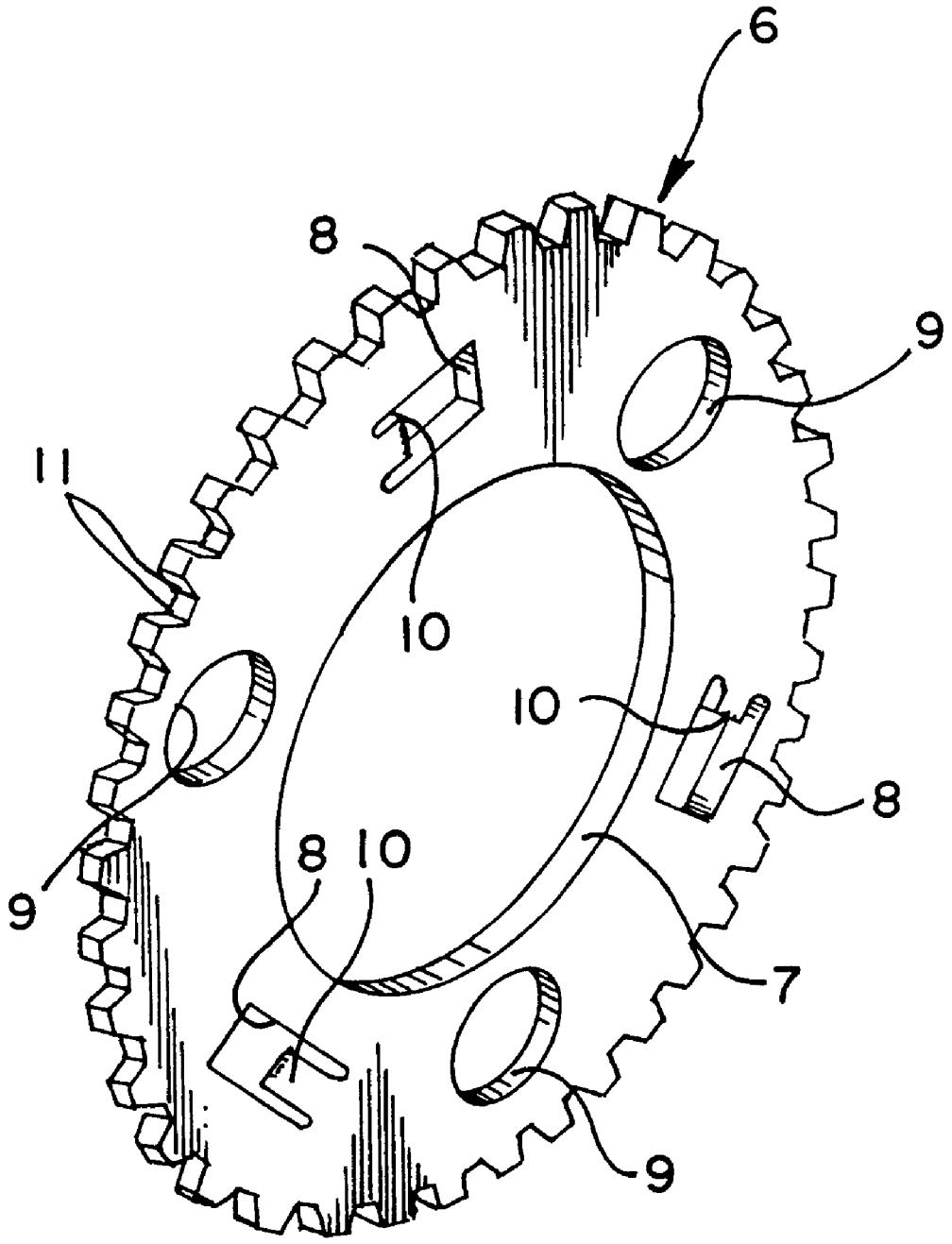
FIG. 2 is a perspective view of a sub-gear.

Referring to FIG. 2, the sub-gear 6 is formed into an annular shape having a fitting hole 7 at a central area. Around the fitting hole 7 are located a plurality of rectangular windows 8 spaced at equal intervals along the circumference, and a plurality of circular holes 9 spaced at equal intervals along the circumference. A cut-and-raised claw 10 is formed at one edge of each rectangular window 8 in the circumferential direction. The cut-and-raised claw 10 functions as one element of the backlash eliminating mechanism. The circular holes 9 are provided for reducing the weight of the sub-gear 6.

The sub-gear 6, which has the fitting hole 7, rectangular windows 8, and circular holes 9, requires a high fatigue strength. In order to obtain this high fatigue strength, the present invention forms the sub-gear 6 using a specific composite steel plate as the beginning material.

The steel plate used in manufacturing the sub-gear 6 has a composition of elements as shown in Table 1.

TABLE 1

| Chemical Composition (wt %) | | | | | | | | | |
|---|---|---|---|---|---|---|---|---|---|
| C | Si | Mn | P | S | Al | Cu | Ti | Ni | Fe |
| 0.002 | 0.018 | 0.25 | 0.014 | 0.002 | 0.05 | 1.24 | 0.05 | 0.7 | balance |

The steel plate is produced using a hot strip mill. The steel plate is subjected to a solution treatment. The solution treatment occurs at a finishing temperature ($T_1$) of 910° C. The steel plate is then rapidly cooled to a winding temperature of 300° C. The thickness of the steel plate is 3.5 mm.

The sub-gear 6 may be produced from the steel plate using a punching process or a hot forging process.

Punching Process

The punching process includes the steps of punching using a press, bending using a press, machining, and soft nitriding (serving as artificial aging). The steps are sequentially performed in the above order.

The above steps will now be described in detail.

A. Punching Using a Press

The punching using a press step includes the following sequentially performed operations. First, the steel plate is punched to form a blank of 110 mm in diameter. Next, the blank is punched to form a semi-finished sub-gear having a teeth portion. Finally, the semi-finished sub-gear is punched to form the fitting hole 7, circular holes 9, and U-shaped slots (later used to form the cut-and-raised claws 10 and rectangular windows 8).

B. Bending Using a Press

The semi-finished sub-gear is next subjected to the bending step to form the cut-and-raised claws 10 and simultaneously to form the rectangular windows 8.

C. Machining

The semi-finished sub-gear is next subjected to the machining step to accurately shape the fitting hole 7. Then, each tooth surface (tip surface and dedendum surface) of the teeth portion of the semi-finished sub-gear is shaved.

D. Soft Nitriding (Serving as Artificial Aging)

The semi-finished sub-gear is next subjected to the soft nitriding (serving as artificial aging) step. The soft nitriding is performed in an atmosphere of $NH_3$ gas based on $N_2$ gas at an artificial aging temperature $T_2$ of 580° C. for a treatment time "t". After this operation, the sub-gear 6 is complete.

The following disclosure will compare various characteristics of sub-gears, prepared with the inventive composite steel plate as the beginning material and in accordance with the invention, with sub-gears prepared with other various composite steel plates as the beginning material.

A first sub-gear obtained, in accordance with the present invention, when the treatment time "t" equals 2 hours will be called Inventive Example 1. A second sub-gear obtained, in accordance with the present invention, when the treatment time "t" equals 3 hours will be called Inventive Example 2.

A first sub-gear prepared with a composite steel plate, having a composition other than the composition according to the present invention, will be called Comparative Example 1. Comparative Example 1 is formed from a steel plate having a thickness of 3.5 mm. The steel plate is made from soft nitriding steel having a composition of C (0.3 wt %); Mn (1 wt %); Cr (1 wt %); V (0.1 wt %); B (0.001 wt %); Fe (balance). A punching process, as set forth above, is used to form the sub-gear, wherein the treatment time "t" is set at 3 hours.

A second sub-gear prepared with a composite steel plate, having a composition other than the composition according to the present invention, will be called Comparative Example 2. Comparative Example 2 is formed from a steel plate having a thickness of 3.5 mm. The steel plate is made from an Al—Cr—Mo steel (JIS SACM 645) treated by quenching and tempering, followed by soft nitriding. A punching process, as set forth above, is used to form the sub-gear, wherein the treatment time "t" is set at 3 hours.

A third sub-gear prepared with a composite steel plate, having a composition other than the composition according to the present invention, will be called Comparative Example 3. Comparative Example 3 is formed from a steel plate having a thickness of 3.5 mm. The steel plate is made from a carburized steel (JIS SCM415H). The sub-gear is formed by a carburizing/quenching process. The carburizing/quenching process is performed by holding the semi-finished sub-gear in a carburizing atmosphere at 910° C. for 1.5 hours and then at 840° C. for 0.5 hours, and then rapidly cooling the semi-finished sub-gear.

Figure 3:
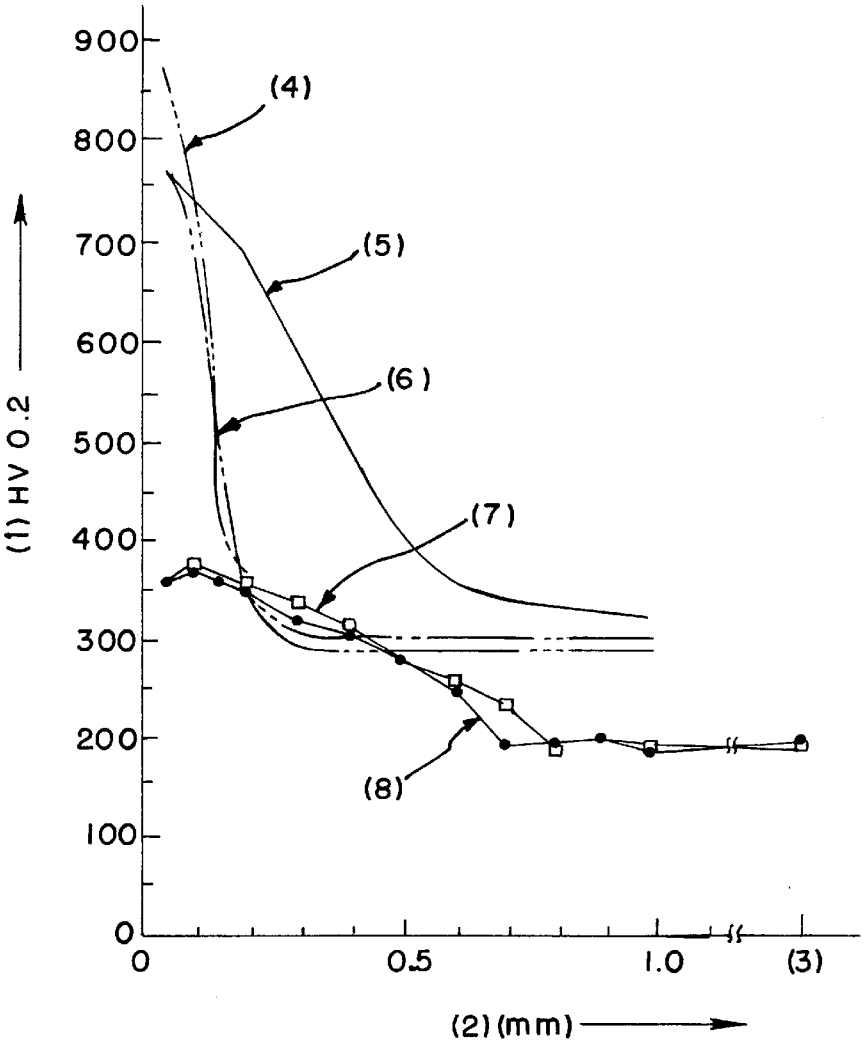
FIG. 3 is a graph showing a relationship between a distance from the surface and a hardness (Hv 0.2) for various sub-gears.

FIG. 3 is a graph showing a relationship between a distance from the surface and a hardness (Hv 0.2) for each of Inventive Examples 1 and 2 and Comparative Examples 1 to 3. As is apparent from FIG. 3, a depth "d" of a surface hardened layer of each of Inventive Examples 1 and 2 is deeper than that of each of Comparative Examples 1 to 3; however, a hardness of the surface, or its vicinity, of each of Inventive Examples 1, 2 is lower than that of each of Comparative Examples 1 to 3.

Inventive Examples 1 and 2 and Comparative Examples 1 to 3 are subjected to a completely reversed, plane bending test for measuring the bending fatigue strength of a dedendum 11 of each example (sub-gear 6).

Figure 4:
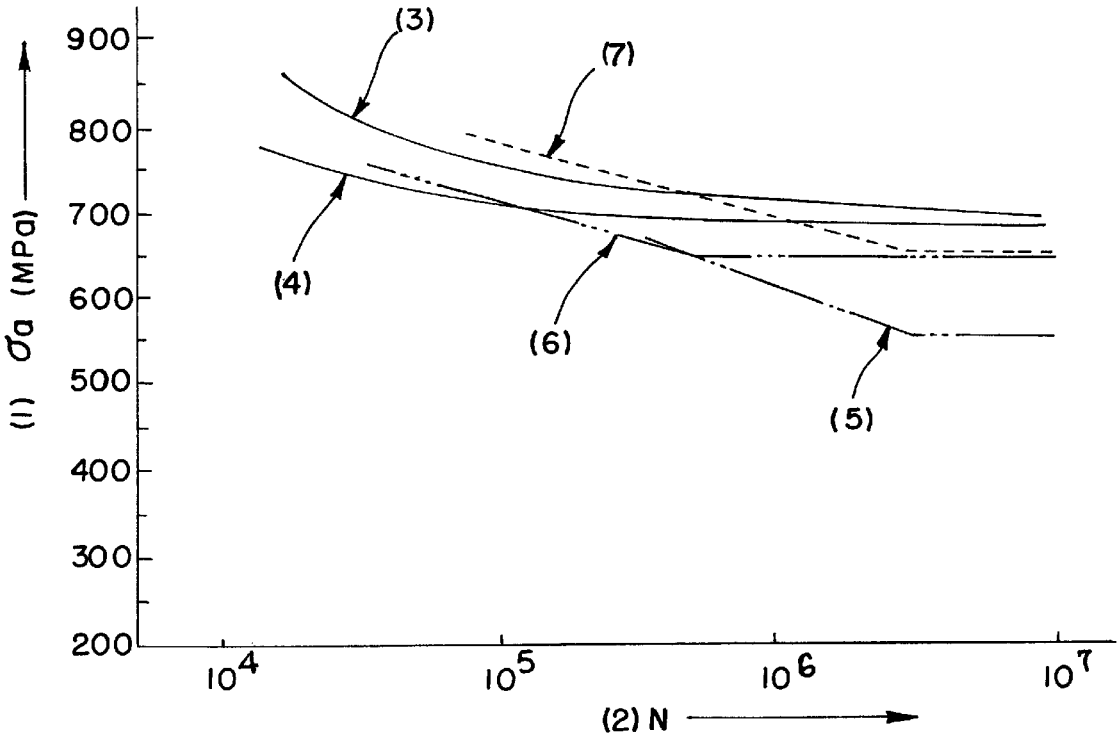
FIG. 4 is a graph showing a relationship between the number N of repetitions of a stress and a stress amplitude ($\sigma_a$).

FIG. 4 is a graph showing a relationship between the number (N) of repetitions of stress and a stress amplitude ($\sigma_a$) for each of Inventive Examples 1 and 2 and Comparative Examples 1 to 3. Table 2 shows the stress amplitude ($\sigma_a$) when the number (N) of repetitions of stress reaches $10^7$ times for each of Inventive Examples 1 and 2 and Comparative Examples 1 to 3.

TABLE 2

| | stress amplitude $\sigma_a$ (MPa) at N = $10^7$ (N: number of repetitions of stress) |
|---|---|
| Inventive Example 1 | 675 |
| Inventive Example 2 | 686 |
| Comparative Example 1 | 549 |
| Comparative Example 2 | 640 |
| Comparative Example 3 | 647 |

As is apparent from FIG. 4 and Table 2, each of Inventive Examples 1 and 2 is higher in bending fatigue strength than each of Comparative Examples 1 to 3.

Hot Forging Process

As stated above, the sub-gear 6 may be produced from the steel plate using a punching process or a hot forging process. The hot forging process will now be described. The hot forging process includes the steps of hot forging, solution treatment, machining, and soft nitriding (serving as artificial aging). The steps are sequentially performed in the above order.

The above steps will now be described in detail.

I. Hot Forging

The hot forging step includes the following sequentially performed operations. First, a steel plate, having a thickness of 30 mm is cut from a round steel bar having a diameter of 50 mm. The steel has a composition as shown in Table 1, above. Next, the steel plate is heated to a temperature of 950° C. Next, any scales on the steel plate are removed. Next, the steel plate is stamped by a high speed forging press. Next, any burrs on the steel plate are removed by a crank press. Finally, the steel plate is shaped.

II. Solution Treatment

The semi-finished sub-gear is next subjected to the solution treatment step by rapidly cooling the semi-finished sub-gear held at 910° C., which is a hot forging ending temperature (solution treatment temperature T1).

III. and IV. Machining, and Soft Nitriding (Serving as Artificial Aging)

The semi-finished sub-gear produced by step II is next subjected to operations similar to those described in steps C and D of the punching process, outlined above. The treatment time "t" in step D is set at 3 hours. The sub-gear 6 thus obtained exhibits a high bending fatigue strength, similar to the bending fatigue strength of Inventive Examples 1 and 2.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A high fatigue strength gear formed from a steel material and made by plastic working, said steel material consisting essentially of:

C≦0.01 wt %, Si≦1 wt %, 0.05 wt %≦Mn≦0.5 wt %, P≦0.1 wt %, S≦0.03 wt %, 0.02 wt %≦sol.Al≦0.1 wt %, 0.8 wt %≦Cu≦1.7 wt %, and 0.02 wt %≦Ti≦0.1 wt %, the balance being Fe and inevitable elements, wherein said gear is subjected to soft nitriding serving as artificial aging, after being subjected to a solution treatment.

2. A high fatigue strength gear according to claim 1, wherein said artificial aging is performed at a temperature $T_2$ within a range of 550° C.≦$T_2$≦600° C.

3. A high fatigue strength gear according to claim 2, wherein said gear is formed from said steel material by punching.

4. A high fatigue strength gear according to claim 2, wherein said gear is formed from said steel material by hot-forging.

5. A high fatigue strength gear according to claim 1, wherein said gear is formed from said steel material by punching.

6. A high fatigue strength gear according to claim 1, wherein said gear is formed from said steel material by hot-forging.

7. A high fatigue strength gear according to claim 1, wherein said steel material has elements in a weight percentage substantially equal to the amounts indicated:

C=0.002 wt %, Si=0.018 wt %, Mn=0.25 wt %,

P=0.014 wt %, S=0.002 wt %, sol.Al=0.05 wt %,

Cu=1.24 wt %, and Ti=0.1 wt %.

8. A high fatigue strength gear according to claim 7, wherein said artificial aging is performed at a temperature $T_2$ within a range of 550° C.≦$T_2$≦600° C.

9. A high fatigue strength gear according to claim 8, wherein said gear is formed from said steel material by punching.

10. A high fatigue strength gear according to claim 7, wherein said gear is formed from said steel material by punching.

11. A high fatigue strength gear formed from a steel material and, lade by plastic working, said steel material consisting essentially of:

C≦0.01 wt %, Si≦1 wt %, 0.05 wt %≦Mn≦0.5 wt %, P≦0.1 wt %, S≦0.03 wt %, 0.02wt %≦sol.Al≦0.1 wt %, 0.8 wt %≦Cu≦1.7 wt %, and 0.02 wt %≦Ti≦0.1 wt %, the balance being Fe and inevitable elements, wherein said gear is subjected to soft nitriding serving as artificial aging, after being subjected to a solution treatment.

12. A high fatigue strength gear according to claim 11, wherein said artificial aging is performed at a temperature $T_2$ within a range of 550° C.≦$T_2$≦600° C.

13. A high fatigue strength gear according to claim 12, wherein said gear is formed from said steel material by punching.

14. A high fatigue strength gear according to claim 12, wherein said gear is formed from said steel material by hot-forging.

15. A high fatigue strength gear according to claim 11, wherein said gear is formed from said steel material by punching.

16. A high fatigue strength gear according to claim 11, wherein said gear is formed from said steel material by hot-forging.

17. A high fatigue strength gear according to claim 11, wherein said steel material has elements in a weight percentage substantially equal to the amounts indicated:

C=0.002 wt %, Si=0.018 wt %, Mn=0.25 wt %

P=0.014 wt %, S=0.002 wt %, sol.Al=0.05 wt %,

Cu=1.24 wt %, Ti=0.1 wt %, and Ni=0.7 wt %.

18. A high fatigue strength gear according to claim 17, wherein said artificial aging is performed at a temperature $T_2$ within a range of 550° C.≦$T_2$≦600° C.

19. A high fatigue strength gear according to claim 18, wherein said gear is formed from said steel material by punching.

20. A high fatigue strength gear according to claim 17, wherein said gear is formed from said steel material by punching.

* * * * *